United States Patent [19]

Hartmann

[11] Patent Number: 4,743,277

[45] Date of Patent: May 10, 1988

[54] ISOLATED FEEDTHROUGH

[75] Inventor: Wolfgang Hartmann, Frankfurt am Main, Fed. Rep. of Germany

[73] Assignee: Metallgesellschaft AG, Frankfurt am Main, Fed. Rep. of Germany

[21] Appl. No.: 89,915

[22] Filed: Aug. 24, 1987

Related U.S. Application Data

[63] Continuation of Ser. No. 842,477, Mar. 21, 1986, abandoned.

[30] Foreign Application Priority Data

Mar. 27, 1985 [DE] Fed. Rep. of Germany ..... 3511059

[51] Int. Cl.[4] ..... B03C 3/76

[52] U.S. Cl. ..... 55/112; 55/146; 55/148

[58] Field of Search ..... 55/112, 146, 147, 148, 55/140

[56] References Cited

U.S. PATENT DOCUMENTS

| | | | |
|---|---|---|---|
| 1,869,475 | 8/1932 | Hale | 55/146 X |
| 1,994,259 | 3/1935 | Thorne | 55/146 X |
| 2,867,286 | 1/1959 | Streuber | 55/147 |
| 2,985,802 | 5/1961 | Drenning | 55/112 |

FOREIGN PATENT DOCUMENTS

| | | | |
|---|---|---|---|
| 351076 | 3/1922 | Fed. Rep. of Germany . | |
| 463528 | 7/1928 | Fed. Rep. of Germany . | |
| 550699 | 9/1932 | Fed. Rep. of Germany . | |
| 886327 | 8/1953 | Fed. Rep. of Germany . | |
| 1093447 | 5/1961 | Fed. Rep. of Germany . | |
| 2556546 | 6/1983 | Fed. Rep. of Germany . | |
| 2914241 | 8/1983 | Fed. Rep. of Germany . | |
| 738241 | 10/1955 | United Kingdom | 55/140 |
| 747179 | 3/1956 | United Kingdom | 55/112 |
| 914299 | 1/1963 | United Kingdom | 55/146 |

*Primary Examiner*—Kathleen J. Prunner

*Attorney, Agent, or Firm*—Karl F. Ross; Herbert Dubno

[57] ABSTRACT

An insulating feedthrough for an electrostatic precipitator has a cylindrical insulator passing through a hole in the wall of the precipitator and having an annular flange which is sealingly pressed against the inner surface of that wall by a clamping arrangement including a spring. A tubular bushing extends through the insulator and has a flange bearing upon the inner end of the latter which is connected by a clamping arrangement to a flange on the support for the electrodes via another spring. A rod for transmitting rapping blows passes through the bushing to impact against the electrode support.

3 Claims, 3 Drawing Sheets

9
8
6
14
ELECTROSTATIC PRECIPITATOR
2
1
3
5
4
HOUSING
IA
15b
15a
IA
15
HIGH-TEMPERATURE SPACE
11
7
10a
12
13
10
HIGH VOLTAGE ELECTRODE SYSTEM (SUBSTITUVE)

ISOLATED FEEDTHROUGH

This is a continuation of co-pending application Ser. No. 842,477 filed on Mar. 21, 1986, now abandoned.

FIELD OF THE INVENTION

My present invention relates to an insulated feedthrough for supplying high-voltage power through a grounded housing wall of a dust-collecting electrostatic precipitator into a space which is at a high temperature (up to 250° C.) and under high pressure (up to 30 bars) and for transmitting rapping blows generated outside that space to the high-voltage electrode system therewithin of the dust-collecting electrostatic precipitator.

BACKGROUND OF THE INVENTION

In dust-collecting electrostatic precipitators, the provision of feedthroughs for high voltages involves various difficulties even if the precipitator is operated under conventional conditions, i.e. under an atmospheric pressure ±200 mbars and at temperatures up to 150° C.

For instance, care must be taken to ensure that the insulators remain free of moisture or dustlike deposits so that creep currents on the insulator and resulting flashovers will be avoided.

That problem has often been attacked by scavenging the insulator with a protective gas which prevents an ingress of contaminated gases and also maintains the insulator at a constant temperature. Various proposals of that kind have been published in German Pat. Nos. 351,076, 463,528, 1,093,447 and 2,914,241.

The provision of feedthroughs for high voltages becomes even more difficult when substantial pressure differences exist between the interior of the dust-collecting electrostatic precipitator and its environment. In that case it is not sufficient for the feedthrough to be insulating and gastight but it must also be strong enough to withstand the pressure applied and it must prevent an escape of gas even when the insulator has been damaged. Feedthroughs meeting said requirements have been proposed in German Pat. Nos. 550,699 and 886,327; German Utility Model No. 1,830,056; and German Pat. No. 2,556,546.

Further difficulties arise when the feedthrough is exposed to high temperature. In such cases most of the soft elastic sealing materials can no longe be used and in addition to the differential thermal expansions of the insulating materials it is necessary to take substantial changes of resistivity into account.

For instance, the resistivity of a conventional ceramic insulating material decreases from $10^{14}$ ohms/cm to $10^{8}$ ohms/cm and in case of a special insulating material decreases from $10^{18}$ ohms/cm to $10^{11}$ ohms/cm in response to a temperature rise from 20° C. to 200° C. Correspondingly larger insulators must be used in such cases and this gives rise to additional problems in design and manufacture.

Since much higher operating voltages are permissible when dust is electrostatically collected under higher pressures and at higher temperatures, it is particularly important in these caess to solve the problems of feedthrough insulators.

Finally, the design of feedthroughs for high voltages is also difficult because the rapping blows produced outside the housing must be transmitted to the corona electrodes which are suspended in the housing by the insulators. Because of the primary use of ceramic insulators which are particularly susceptible to impact stresses it is necessary to ensure that the rapping blows will be transmitted by the feedthroughs into the interior of the housing in such manner that the insulators will not be subjected to mechanical impact loads.

OBJECTS OF THE INVENTION

It is an object of the invention to provide an insulated high-voltage feedthrough which meets all of the requirements described and ensures that dust will be electrostatically collected in a safe operation.

Another object of my invention is to provide a feedthrough insulator for electrostatic dust-collecting precipitators which avoids the drawbacks of the earlier devices described.

Another object is to provide a feedthrough insulator which can allow operation of the electrostatic precipitator at higher temperatures of pressures and nevertheless allows transmission of rapping impacts to the corona electrodes suspended from such insulators without damaging the insulating elements.

SUMMARY OF THE INVENTION

These objects and others which will become apparent hereinafter are accomplished in accordance with the invention by a feedthrough which comprises in combination (a) a cylindrical insulator, which has a central through bore and is adapted to extend through an opening of the electrostatic precipitator housing wall and is integrally formed with a flange which is secured to the housing wall in sealing relationship or contact with its inside surface;

(b) a conductive tubular bushing disposed in the through bore and having a flange firmly connected to the bushing at its inner end (i.e. and within the precipitator), the bushing being provided at its outer end with a screw connected clamping element for axially clamping the bushing against the insulator;

(c) a rod extending through and longitudinally movable in the bushing and at its outer end of said rod adapted to be acted upon by a rapping device whereas the inner end of the rod is adapted to rest on a supporting member for the high voltage electrode system;

(d) a clamping device provided with a sealing compensator and forcing the supporting member against the flange of the bushing; and (e) spring elements, which 1. compensate differential thermal expansions of the interconnected parts,
2. maintain the contact pressure required for a seal, and
3. attenuate or damp the transmission to the insulator (1) of the rapping blows produced by the rapping device.

BRIEF DESCRIPTION OF THE DRAWING

The above and other objects features and advantages of the invention will become more readily apparent from the following description, reference being made to the accompanying drawing, in which.

SPECIFIC DESCRIPTION

Figure 1:
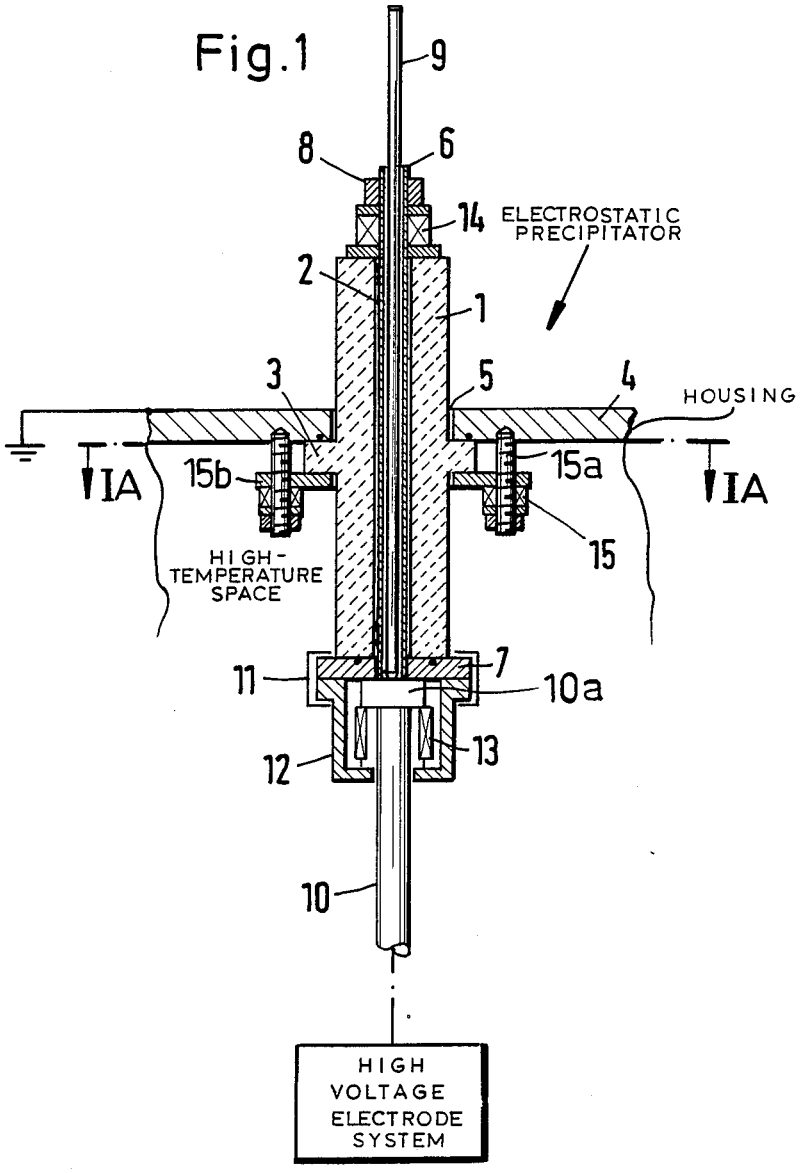
FIG. 1 is an axial section through a feedthrough insulator according to the invention.
Figure 1A:
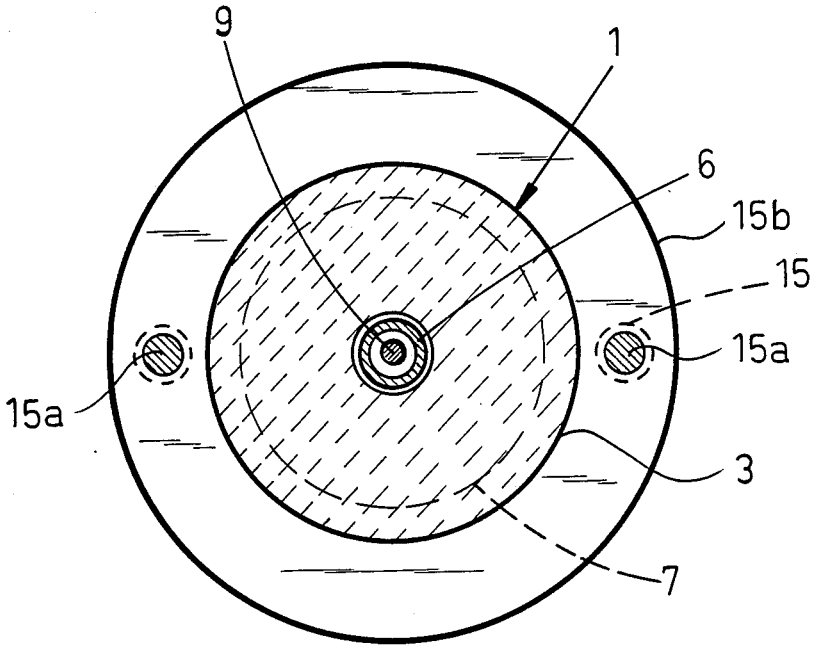
FIG. 1A is a section taken along line IA—IA of FIG. 1.

The drawing is a somewhat diagrammatic, vertical sectional view showing an embodiment of the feedthrough in accordance with the invention.

The cylindrical insulator 1 is made of an insulating ceramic material and has a central through bore 2.

It has been inserted from below through an opening 5 in the grounded housing wall 4 and is integrally formed with a flange 3, which is secured to the housing wall 4 and in sealing contact with its inside surface, preferably an O-ring 3*a* in a suitable recess can assist in sealing.

The through bore 2 contains a conductive tubular bushing 6, which is firmly connected at its inner end to a flange 7.

A clamping element or unit 8 is screwed on the outer end of the bushing 6 and axially clamps the bushing against the insulator 1. The bushing 6 is connected on the outside to the high-voltage source, not shown, via the nut 8 and on the inside establishes by means of the flange 7 a high-voltage contact to the supporting member 10 for the high-voltage electrode system. By clamping means including C-brackets 11 and a flanged sleeve 12, the flange 10*a* of the supporting member 10 is firmly connected to the flange 7.

A sealing compensator 13 is provided, which under all operating conditions ensures that the supporting member 10 will be firmly forced against the flange 7 of the bushing 6.

The bushing 6 also contains a longitudinally movable rod 9, which is adapted to be acted upon at its outer end of rapping means and which at its inner end rests on the supporting member 10 for the high-voltage electrode system. As a result, rapping blows applied on the outside can be directly mechanically transmitted directly to the supporting member 10. The sealing compensator and the spring elements 14 and 15 ensure that different thermal expansions of the interconnected elements will be compensated, that the contact pressure required for a seal will be maintained, and that the transmission to the insulator 1 of the rapping blows produced by the rapping means will be attenuated.

Figure 2:
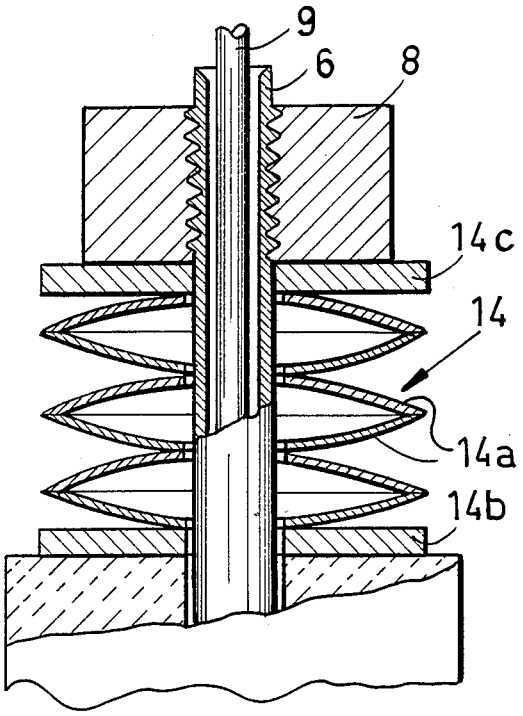
FIGS. 2 through 4 are detailed sections through the insulator assembly of FIG. 1.

As can be seen from FIG. 2, the bushing 6 is externally threaded and engaged by the nut 8 which bears axially on a washer 14*c* forming a seat for the stack of belleville washers 14*a* forming the spring element 14. The stack is seated against a washer 14*b* resting against an end face of the insulator 1 to prevent wear of the latter by spring movements.

Figure 3:
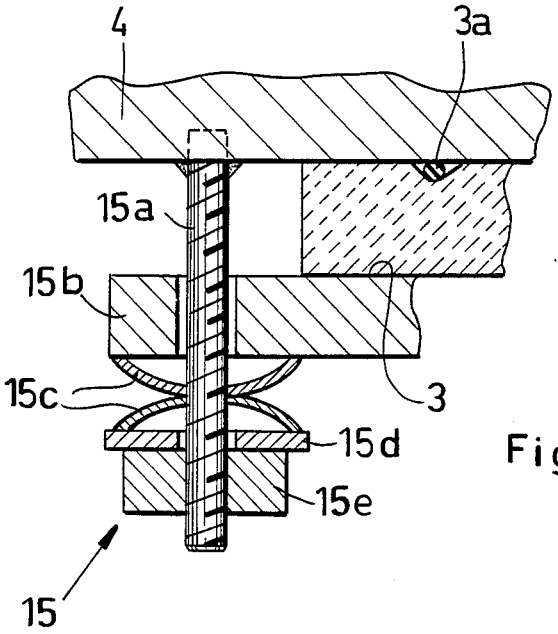

The spring elements 15 which retain the annular flange 3 against the inner surface of the wall 4 can include threaded rods 15*a* welded to this wall and traversing an annular plate 15*b* bearing on the flange 3. The rods 15*a* constitute formations affixed to the wall and bearing nuts 15*e* against which springs 15*c* are forced. Nuts 15*e* are threaded onto the rods 15*a* and via washers 15*d* precompress the springs formed by stacks of belleville washers 15*c* (FIG. 3).

Figure 4:
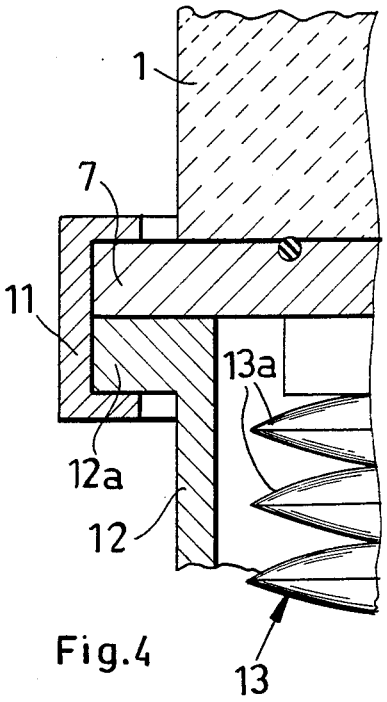

The belleville washers 13*a* of the spring element 13 are visible in FIG. 4 in which the C-brackets clamping the flange 12*a* of sleeve 12 to the flange 7 has been shown in greater detail.

I claim:

1. In an electrostatic precipitator having a housing formed with a housing wall:

an electrode supporting member in said housing; and an insulated feedthrough extending through said wall into a space within said housing for supplying electric power to said space and rapping blows to electrodes therein on said electrode supporting member, the improvement wherein said feedthrough comprises:

a cylindrical insulator formed with a central through bore and extending through an opening of said housing wall and integrally formed with a flange secured to the housing wall in sealing relationship with an inside surface thereof;

means in said space including an annular plate surrounding said insulator and affixed to said wall along said inside surface thereof for pressing said flange integrally formed on said insulator against said inside surface all around said opening;

a conductive tubular bushing disposed in said through bore and having a flange firmly connected to an inner end thereof, said bushing being provided at an outer end with a screw-connected clamping element axially clamping said bushing against said insulator, said bushing conducting electric current through said insulator;

a rod extending through and longitudinaly movable in said bushing for transmitting impact rapping to said electrode supporting member in said space;

a clamping device provided with a sealing compensator having means for forcing said supporting member against said flange of said bushing; and wherein said means for pressing includes spring elements including at least one spring braced against said plate to compensate differential thermal expansions of interconnected parts of the feedthrough. maintain contact pressure required for sealing, and attenuate transmission to the insulator of rapping blows applied to said rod.

2. The electrostatic precipitator defined in claim 1 wherein said compensator comprises a flange on said supporting member, and a spring bearing upon said flange of said supporting member to urge it yieldably against said flange of said bushing.

3. The electrostatic precipitator defined in claim 2 wherein a spring is braced between an end of said insulator and said clamping element.

* * * * *